US007631672B2

(12) United States Patent
Spencer

(10) Patent No.: US 7,631,672 B2
(45) Date of Patent: Dec. 15, 2009

(54) PORTABLE HYDRATION SYSTEM WITH RESUPPLY SYSTEM

(76) Inventor: Christerson Abraham Spencer, 12246 Haroldson Forest Dr., Houston, TX (US) 77044

( * ) Notice: Subject to any disclaimer, the term of this patent is extended or adjusted under 35 U.S.C. 154(b) by 549 days.

(21) Appl. No.: 11/289,855

(22) Filed: Nov. 30, 2005

(65) Prior Publication Data

US 2006/0113336 A1 Jun. 1, 2006

Related U.S. Application Data

(60) Provisional application No. 60/642,393, filed on Jan. 8, 2005, provisional application No. 60/631,945, filed on Nov. 30, 2004.

(51) Int. Cl.
*B65B 1/04* (2006.01)

(52) U.S. Cl. ..... 141/18; 141/2; 224/148.2; 224/148.7

(58) Field of Classification Search ..... 141/2, 141/10, 18, 114, 383; 224/148.1–148.7
See application file for complete search history.

(56) References Cited

U.S. PATENT DOCUMENTS 2,069,383 A * 2/1937 Nedbalek ..... 215/4
4,090,650 A 5/1978 Gotta
4,139,130 A 2/1979 Glusker et al.
4,420,097 A 12/1983 Motsenbocker
4,629,098 A 12/1986 Eger
5,085,349 A 2/1992 Fawcett
5,607,087 A 3/1997 Wery et al.
5,722,573 A * 3/1998 Carnel ..... 224/148.2
5,727,714 A 3/1998 Fawcett
5,788,134 A 8/1998 Matic, Jr.
5,988,464 A * 11/1999 Butler et al. ..... 224/148.4
6,283,344 B1 9/2001 Bradley
6,364,168 B1 4/2002 Gardner et al.
6,722,533 B2 4/2004 Skillern
2005/0268572 A1 * 12/2005 Setton ..... 53/410

* cited by examiner

*Primary Examiner*—Timothy L Maust
*Assistant Examiner*—Jason K Niesz
(74) *Attorney, Agent, or Firm*—Craig E. Bohn

(57) ABSTRACT

A fluid hydration system for providing a replenishable supply of fluid by replacing a depleted fluid reservoir with a replacement fluid reservoir, and housing such reservoir in a protective housing specifically designed to withstand the rigors of particular rigorous activities, such as football, hockey or combat. The inventive system comprises a conduit for communication of fluid from a supply area, at least one reservoir, releasably securable in an appropriately protective supply area, for containing a supply of fluid, and a connector for releasably connecting the conduit in fluid communication with a selected reservoir.

14 Claims, 6 Drawing Sheets

PORTABLE HYDRATION SYSTEM WITH RESUPPLY SYSTEM

CROSS-REFERENCE TO RELATED APPLICATIONS

This application claims the benefit of U.S. Provisional Application No. 60/631,945, filed Nov. 30, 2004, and U.S. Provisional Application No. 60/642,393, filed Jan. 8, 2005.

STATEMENT REGARDING FEDERALLY SPONSORED RESEARCH OR DEVELOPMENT

Not applicable.

BACKGROUND OF THE INVENTION

1. Field of the Invention

The invention is generally related to hydration systems having a replenishable fluid supply and more specifically to a fluid supply protectively and replaceable attached to a piece of personal equipment.

2. Description of the Related Art

Hydration systems are widely known in the field. Such systems generally comprise a transportable reservoir for maintaining a supply of fluid and a conduit to transport the fluid from the reservoir to the fluid consumer. As the supply of fluid diminishes one is able to replenish the supply by refilling the hydration reservoir.

Various hydration systems are known in the field of portable hydration, of which some include:

- U.S. Pat. No. 4,139,130 issued to Glusker et al. on Feb. 13, 1979, discloses a canteen belt that is easily worn for use by an athlete, which provides a supply of liquid without interfering with the athlete's physical endeavor.
- U.S. Pat. No. 4,090,650 issued to Gotta on May 23, 1978, discloses a canteen having a straw extending through the top of a cap and reachable to the bottom of the canteen interior.
- U.S. Pat. No. 4,629,098 issued to Eger on Dec. 16, 1986, discloses a portable liquid dispenser suitable for use by persons while performing an activity, having a single flexible dispensing tube in fluid communication with a pair of opposing one-way parallel passages, and the tube connected at one end to the container filling cap and the other to a dispensing valve. The container may be pressurized to facilitate pressure assisted fluid dispensing by operation of a compressible bulb that forces air into the container through the inlet one-way passage.
- U.S. Pat. No. 4,420,097 issued to Motsenbocker on Dec. 13, 1983, discloses a portable liquid dispenser with carrying case having a pillow shaped, plastic sheet material container in fluid communication with a flexible tube, where the tube has a valve at the distal end for controlling the flow of fluid from the container through the tube.
- U.S. Pat. Nos. 5,085,349 and 5,727,714 issued to Fawcett on Feb. 4, 1992 and Mar. 17, 1998, respectively, disclose a resilient valve and dispensing system for bicyclists having a collapsible reservoir attached to a flexible tube, where the tube has a valve at the distal end for controlling the flow of fluid from the container through the tube by deforming the shape of the valve to widen a slit opening therein.
- U.S. Pat. No. 5,607,087 issued to Wery et al. on Mar. 4, 1997, discloses a pressurized fluid dispensing device for storing and dispensing fluid to an individual during the performance of an assortment of physical activities. A fluid reservoir is pressurized by slidingly inserting a pressure adapter into the filler opening, and charging the system with a common air pressurizing system.
- U.S. Pat. No. 5,788,134 issued to Matic, Jr. on Aug. 4, 1998, discloses a liquid carrying apparatus for a bicycle having a liquid holding tank attachable to the frame of a bicycle and also having a hose disposed in the tank and extending to within the reach of an operator in order to permit fluid communication through the hose to operator.
- U.S. Pat. No. 6,283,344 issued to Bradley on Sep. 4, 2001, discloses a hands-free personal hydration delivery system that provides a feed tube, connectable to a remote fluid supply, where the tube is securable to a user's head, either by attachment to a helmet or hat, or by a various specialized head mounts.
- U.S. Pat. No. 6,364,168 B1 issued to Gardner et al. on Apr. 2, 2002, discloses a personal hydration system with an improved mouthpiece that provides a greater bite valve activation area.
- U.S. Pat. No. 6,722,533 B2 issued to Skillern on Apr. 20, 2004, discloses a hydration pouch with a detachable hose, such that the hose may remain in configuration for use while the pouch may be replenished, chilled or cleaned.

It would be an improvement to the art to provide a protective housing for a hydration reservoir, specifically adapted for particular rigorous activities, such as football or combat, from which housing the reservoir may be easily removed for fluid replenishment or reservoir replacement.

BRIEF SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

In at least one illustrative embodiment, the invention is a hydration system that permits easy replacement of the reservoir, such that replenishing the supply of fluid is as simple as removing a depleted reservoir and attaching a reservoir with additional fluid. The inventive device is particularly suited for adaptation with various types of personal equipment, such as sporting equipment, where quick and convenient fluid supply replenishment is favorable. An exemplary adaptation includes configuring the device to attach to football shoulder pads, where the reservoir removably attaches to the rigid pad assembly and a protective housing is provided to prevent damage to the reservoir during football activity. An exemplary adaptation includes configuring the device to attach to personal body armor, where the reservoir removably attaches to the rigid pad assembly and a protective housing is provided to prevent damage to the reservoir during harsh physical activity. An additional exemplary adaptation may include removably attaching the reservoir to a bicycle such that a replacement reservoir may be easily installed by the rider or a person adjacent to the bicycle and rider during operation. An additional exemplary adaptation includes removably holding the reservoir to a harness that is securely attachable to a person's body, holding the reservoir suitably during prolonged physical activity, such as a marathon. Reservoir may be appropriately placed by a second person's personal equipment where that person may travel adjacent to the athlete without hindering the athletic performance of the athlete, so the athlete may continue with the physical activity.

An alternative exemplary embodiment includes the capacity for selective connectivity to a refill reservoir for replenishment of the main reservoir. Alternative embodiments include accomplishing refill flow by use of gravity, air pressure created in the refill reservoir and fluid pressure created in the refill reservoir, but other methods of promoting fluid flow within the inventive system may be appreciated as obvious given the teaching of this disclosure.

Many of these exemplary embodiments may include various integrated garments designed that may provide the features, individually or in combination, to compliment access to the reservoir for replenishment operations, provide protection, provide support and provide stability to the reservoir and housing system.

BRIEF DESCRIPTION OF THE DRAWINGS

The invention may be understood by reference to the following description taken in conjunction with the accompanying drawings, in which like reference numerals identify like elements, and in which.

Figure 1:
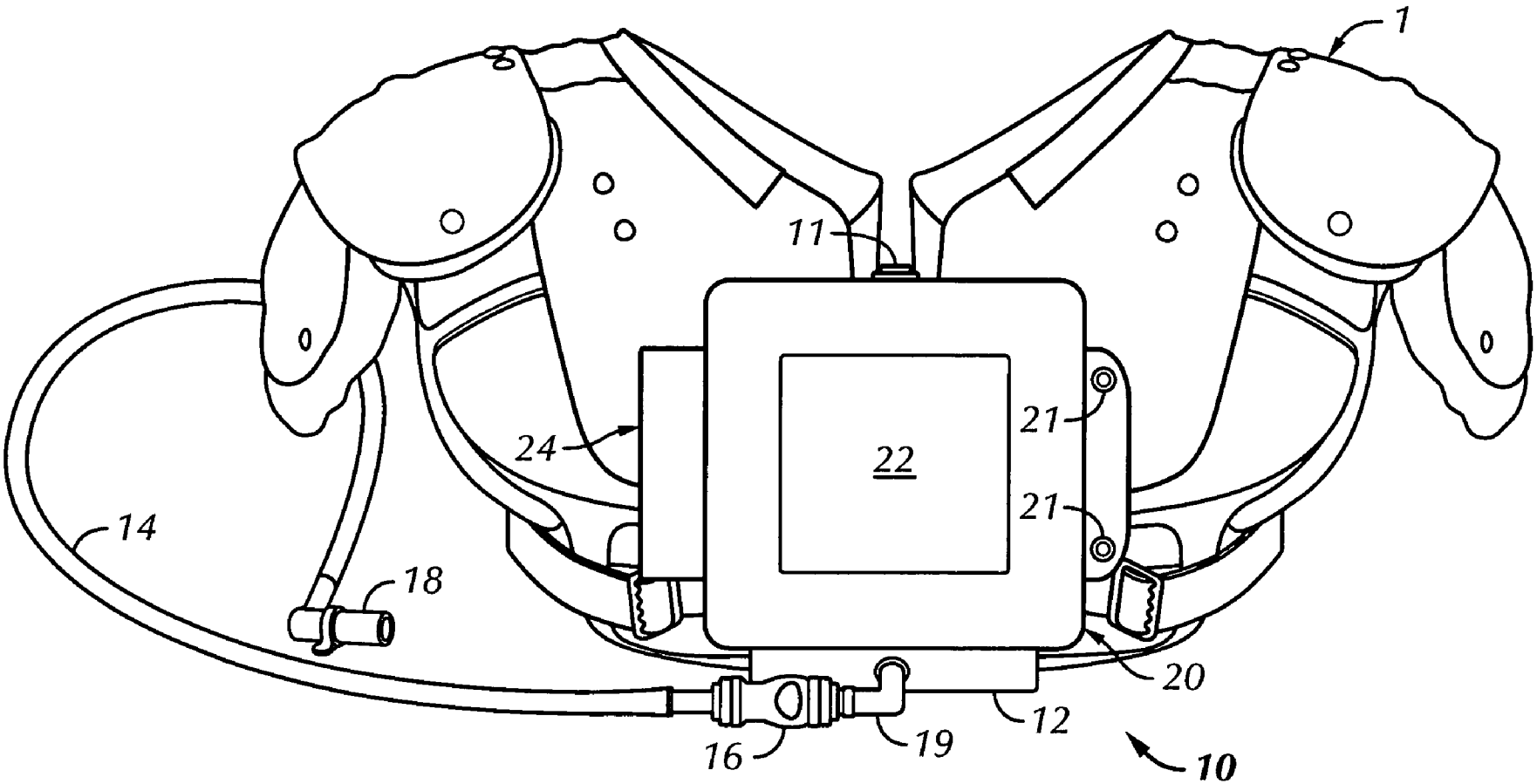
FIG. 1 is a rear view of an exemplary embodiment of the invention integrated into protective football equipment.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 2:
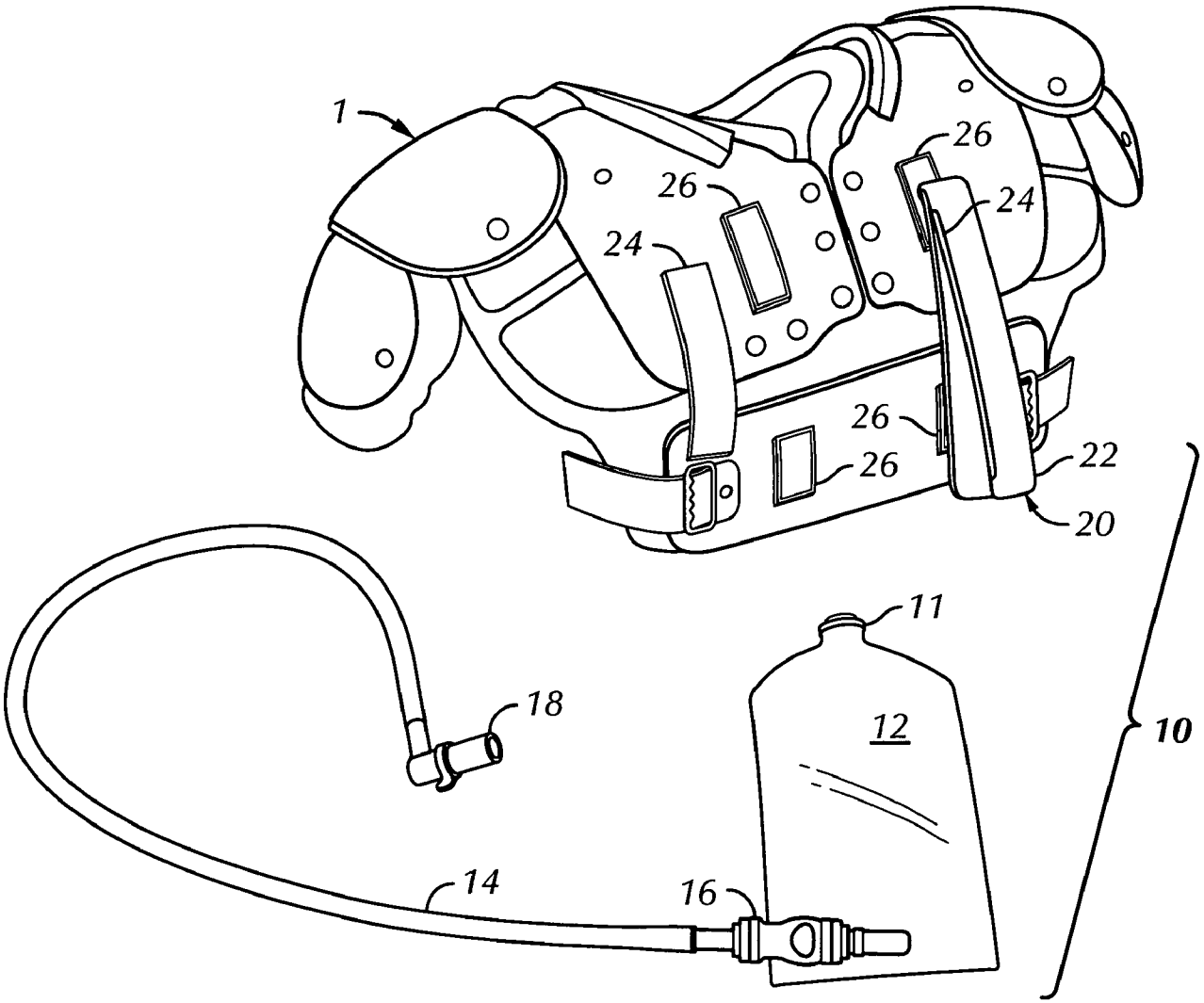
FIG. 2 is a perspective view of the embodiment of FIG. 1 with the reservoir separated from the protective housing and personal equipment.

FIGS. 1 and 2 depict an exemplary piece of personal equipment, specifically athletic equipment of a football shoulder pad assembly 1, adapted to protectively comprise hydration assembly 10. The exemplary hydration assembly 10 is generally comprised of fluid reservoir 12, for holding and dispensing a quantity of liquid, positioned within a protective area 20. Hydration assembly 10 may additionally include feedline or conduit 14, connector 16 and feed spout or valve 18. Reservoir 12 may take the form of various types of containers known to hold fluid without leaking and permit controlled release of fluid through a flow valve. Exemplary reservoir 12 is a flexible bag having filler cap 11 at one end and flow outlet 19 at the other end. Connector 16 attaches intermediate to flow outlet 19 and conduit 14, effectively connecting conduit 14 to reservoir 12 to support fluid communication therebetween such that fluid from reservoir 12 may flow through flow outlet 19, through connector 16 and into conduit 14. Conduit 14 provides communication of fluid from reservoir 12 to valve 18, effectively transporting fluid from protective area 20 that provides protection to reservoir 12, to a hydration point such as an individual's mouth.

As known in the art, shoulder pad assembly 1 is constructed of both soft padded and rigid materials. In order to provide protection from the inherent rigors of the play of football, exemplary protective area 20 may be constructed of a similarly tough material as the rigid materials of shoulder pad assembly 1. In the exemplary embodiment protective area 20 is comprised of housing 22 hingedly secured to one side edge by rivets 21 and releasably securable on the opposing side edge by hook and loop fastener strip 24. It is understood the one component of the hook and loop fastener strip 24 is permanently affixed to the shoulder pad assembly 1 and the other component is permanently affixed to the edge of housing 22. This configuration permits filler cap 11 to project out the top and flow outlet 19 to extend out the bottom of housing 22. In alternative exemplary embodiments either or both rivets 21 and hook and loop fastener strip 24 may be replaced with suitable hardware connectors (not shown), such as grommets, screws, nut and bolt assemblies, toggle bolts or wing nut assemblies, as a few examples.

Exemplary valve 18 is attached to conduit 14 removed from reservoir 12 in order to permit easy operation by a user. Exemplary valve 18 is a mouth-activated valve, known in the field, which inhibits fluid flow unless pressure is applied to its exterior, such as in biting down on the body of the valve. The applied pressure opens the valve permitting fluid to flow through conduit 14 and valve 18. Various forms of valve 18 are known in the field of portable hydration and may be suitable for use with the invention. In the exemplary embodiment, valve 18 is positioned, and may be removably secured, to shoulder pads 1 in the front, adjacent to where a wearer's mouth would be.

In the exemplary embodiment additional securement is provided to reservoir 12 by hood and loop fastener strips 26, which have corresponding components affixed to the shoulder pad assembly 1 in the area coverable by housing 22, and the exterior of reservoir 12. Though it is not presently seen on reservoir 12, one skilled in the art would understand the application and use of hood and loop fastener strips 26.

Figure 3:
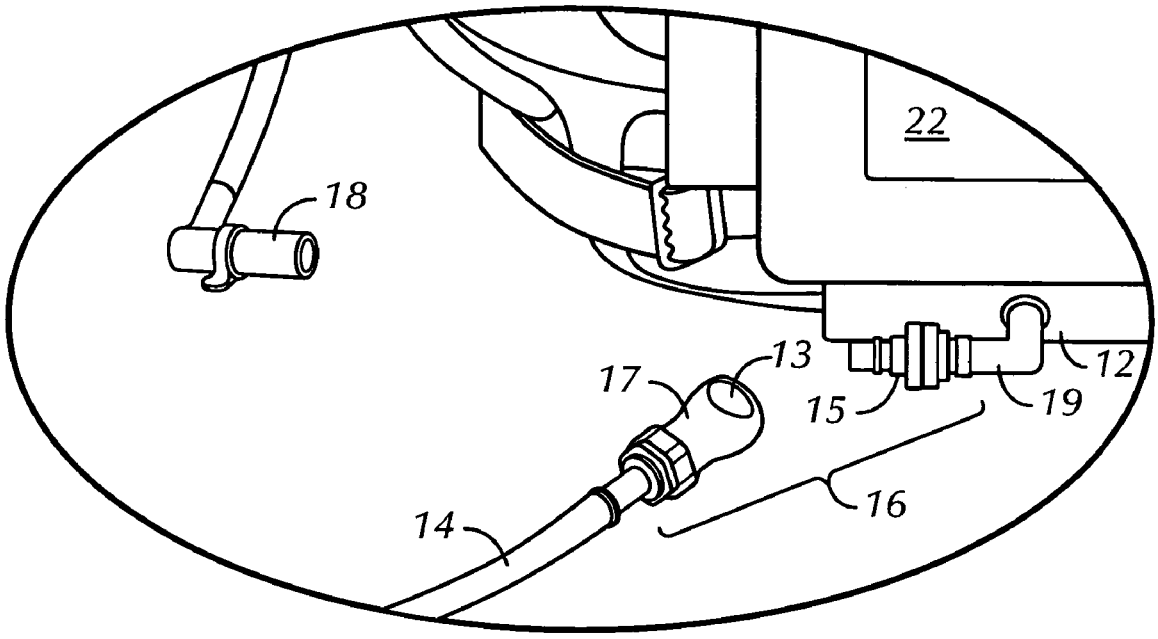
FIG. 3 is a close view of an exemplary reservoir connection configuration.

FIG. 3 shows exemplary connector 16 comprises two components. In a separated state, where one component, insert 15, remains securely connected to flow outlet 19, while the other component, receiver 17, is removed from insert 15. Detent button 13 releases a catch that secures insert 15 within receiver 17 so that the two components may be separated. Inserting insert 15 into receiver 17 sufficiently permits a catch operatively connected to detent button 13 to reengage, securing the two components of connector 16. With the two components secured into unitary connector 16 fluid may travel between flow outlet 19 and conduit 14. Exemplary connector 16 is just one embodiment of suitable connectors that should be obvious to the field given this disclosure.

Figure 4:
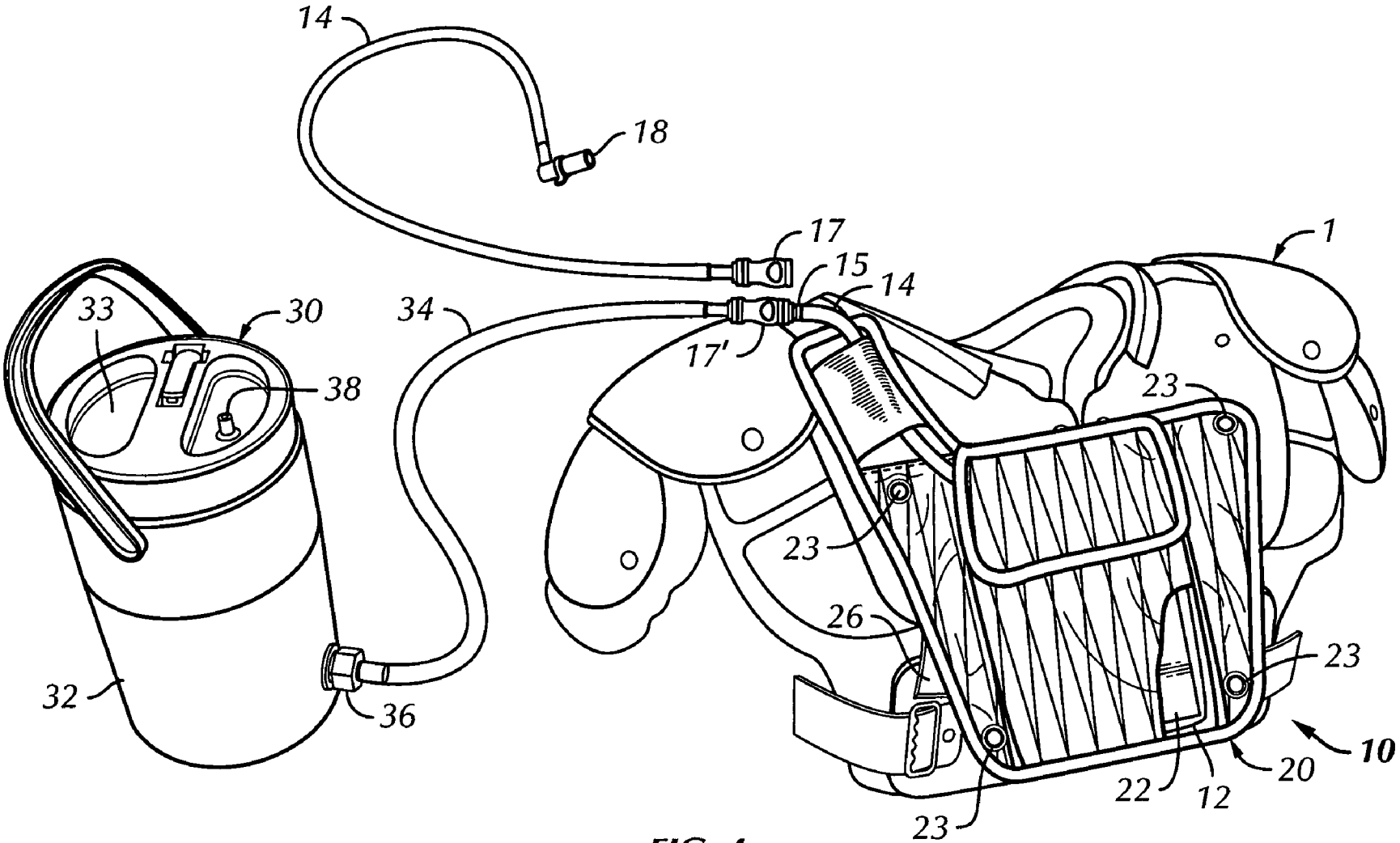
FIG. 4 is a perspective view of an exemplary refill system and an alternate exemplary embodiment of the invention.

FIG. 4 shows exemplary refill system 30 connected to an alternate exemplary embodiment of hydration assembly 10. An alternate exemplary protective area 20 is shown cut-away to show a fabric covering over housing 22, which covers reservoir 12. Exemplary protective area 20 contains grommets 23 through which screws (not shown) may be inserted to secure protective area 20 to the personal equipment. In the exemplary embodiment, protective area 20 is held to the protective equipment with hook and loop fastener strips 26. Refill system 30 may replenish a fluid supply into reservoir 12 while positioned within protective area 20, through conduit 14. In the exemplary embodiment connector 16 is located a distance along conduit 14 away from protected area 20. Refill conduit 34 connects into conduit 14 at connector 16. Receiver 17 may be removed from insert 15 and refill receiver 17' may be inserted into insert 15 establishing fluid communication between refill system 30 and reservoir 12.

The invention envisions various methods of creating flow of a fluid supply in refill reservoir 32 into reservoir 12. The exemplary system may promote flow from refill reservoir 32 into reservoir 12 by gravity, where refill reservoir 32 is positioned at a greater elevation with respect to reservoir 12. Alternatively, the exemplary system may have a pressurization system wherein a pressurized air supply is given access the interior of refill reservoir 32 through pressurization valve 38. As pressurized air (not shown) enters refill reservoir 32, fluid (not shown) inside reservoir 32 may be forced out reservoir outlet 36, through refill conduit 34, connector 16 and conduit 14, and ultimately into reservoir 12. In an alternative embodiment, refill reservoir 32 may be pressurized by incorporating a lever pump (not shown), as known in pressurized sprayers. When pressurize flow is employed a valve (not shown) may be included in reservoir outlet 36 to permit selective flow from refill reservoir 32. The supply of refill fluid may be replenished within refill reservoir 32 by removing refill top 33 to access the interior of refill reservoir 32.

Existing hydration systems include forced flow hydration systems. The current invention includes the adaptation of such systems by providing an adapter (not shown), configured as receiver 17', in FIG. 4, that can attach to the liquid outlet of the hydration system, permitting the existing hydration system to become a refill reservoir. The second adapter (not shown) may then be provided to insert into receiver 17' in the same manner as insert 15, but instead of being attached to conduit 14, the other end of the insert 15 would be configured as a selectably open drinking top, as found in many sports water bottle. This makes the inventive hydration refill reservoir suitable to provide direct hydration to individuals not in possession of an entire hydration assembly 10.

Figure 5:
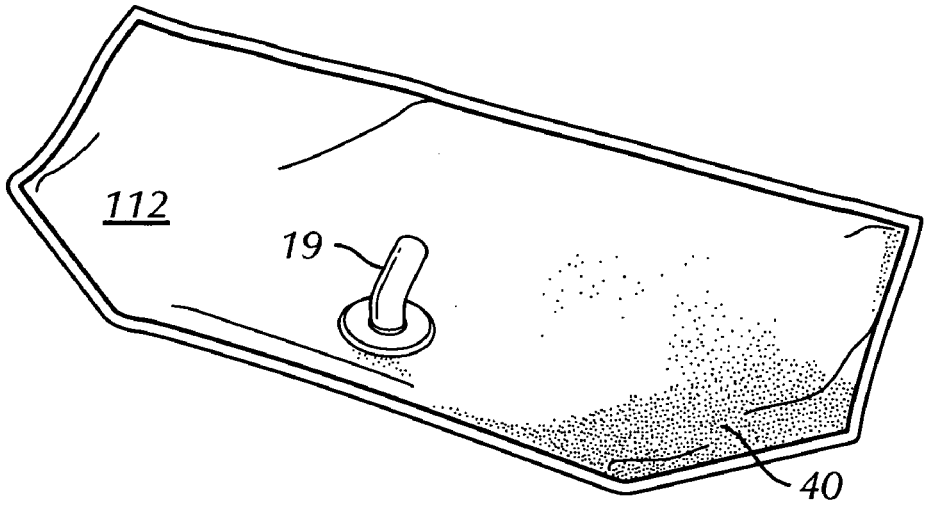
FIG. 5 is a perspective view of an alternative exemplary fluid reservoir containing a beverage powder.

FIG. 5 shows an alternative exemplary fluid reservoir 112. Fluid reservoir 112 may be a pouch that is completely sealed except for outlet 19. Fluid reservoir 112 is shaped to be containable within protective area 20 and designed to integrate into the other components of hydration assembly 10. Such a fluid reservoir 112 may be used a limited number of times and disposed of rather than cleaned for reuse. The invention includes the process whereby fluid reservoir 112 may be supplied to an area for use without containing a fluid, making it lighter and more convenient to transport.

As part of the inventive process, the exemplary embodiment of reservoir 112 is pre-filled with a serving of appropriate beverage powder 40. The serving size would depend on the capacity of reservoir 112. The process further includes filling the reservoir 112 with liquid either before or after connected into the balance of hydration assembly 10. An exemplary embodiment of the inventive process further includes connecting reservoir 112 into hydration assembly 10 and subsequently filling reservoir 112 with an appropriate amount of water (not shown), inserted through outlet 19 by a variety of refill means disclosed in this disclosure, prior to athletic activity. In an alternate embodiment of the inventive process includes connecting reservoir 112 into hydration assembly 10 after being filled with an appropriate amount of liquid (not shown). If beverage powder 40 is present, the process may include permitting beverage powder 40 to dissolves inside reservoir 112, creating a sports beverage (not shown). The process may include allowing additional time to permit the beverage powder 40 to completely dissolve prior to use for hydration. An exemplary embodiment of the inventive process may include filling a number of reservoirs 112 with liquid in anticipation of use prior to a time when they will be needed. Suitable beverage powders 40 that dissolve into water to make hydrating sports drinks are know in the field. An exemplary embodiment may also include any, or a combination of, refilling a depleted reservoir 112 during break intervals of the athletic activity, disposing of the depleted reservoir and replacing the depleted reservoir.

Figure 6:
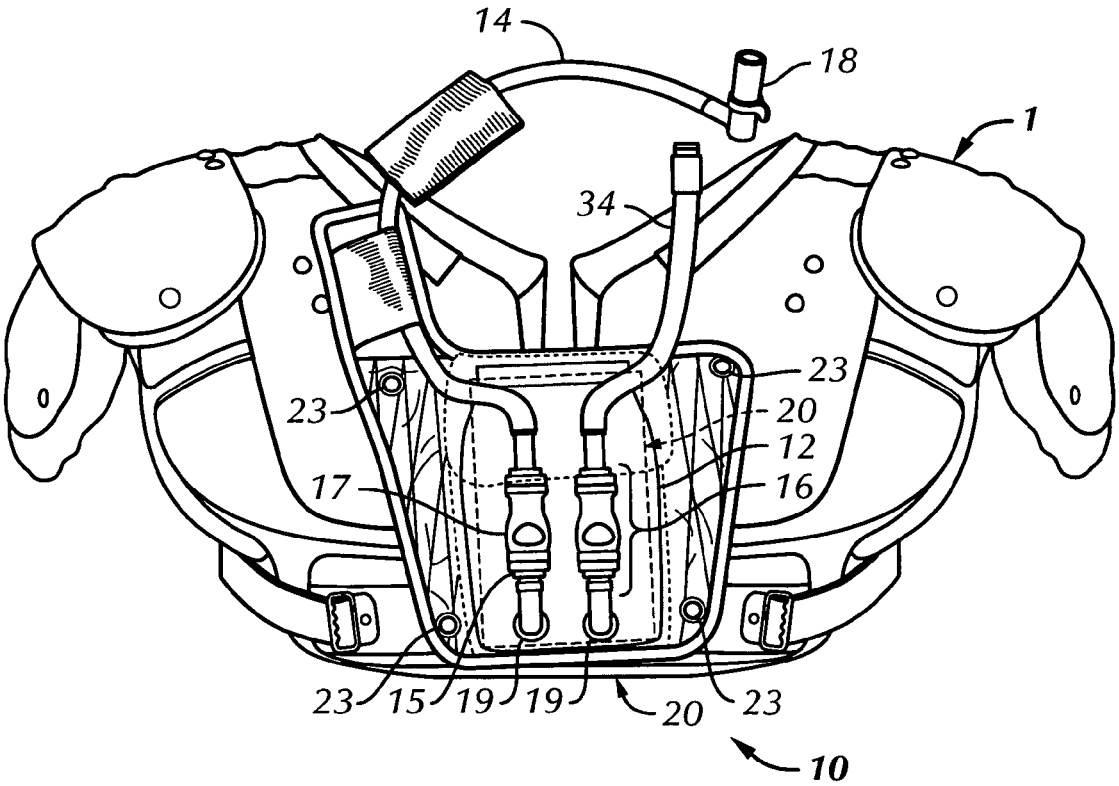
FIG. 6 is a rear view of an alternate exemplary embodiment of the invention.

FIG. 6 shows an alternate exemplary embodiment of hydration assembly 10 having two outlets 19 from reservoir 12. In this embodiment one outlet 19 may be connected to conduit 14 as previously discussed, while another outlet 19 may be connected to refill conduit 34. The connection between conduit 14 and 34 may or may not include connector 16, since each outlet may be used for dedicated inward or outward flow. However, including connectors 16 selectively permits easy removal of reservoir 12 for maintenance, cleaning or replacement.

Figure 7:
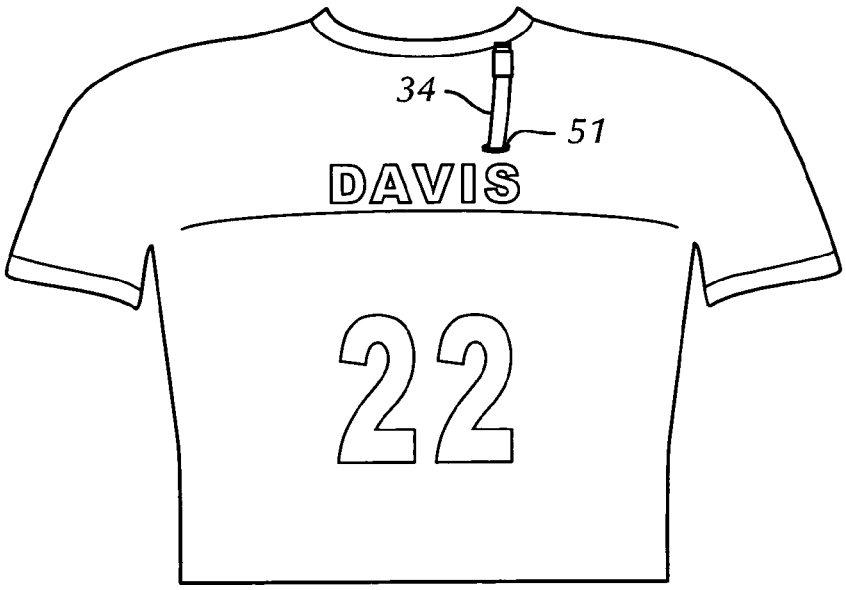
FIG. 7 is a rear view of an exemplary complimentary garment configured over the embodiment of FIG. 6.

Referring to FIG. 7, to assist in refill operations this invention contemplates and includes modifications to pieces of apparel in order to facilitate access to either or both reservoir 12, 112 and conduit 14. Such modifications may include access orifices constructed into the apparel or formed in the apparel as an end-use modification, such as exemplary orifice 51. A non-exhaustive list of potentially suitable access types include hole, open seam, zipper opening, hook and loop fastener opening, button opening or flap. The use of these accesses and others not mentioned, but envisioned as equivalents are considered as part of this invention.

Figure 8A:
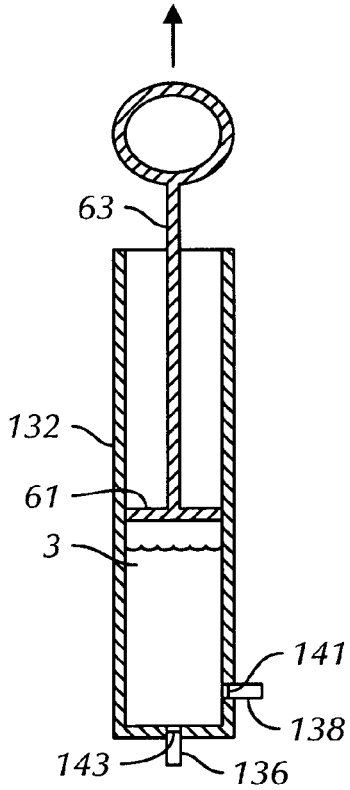
FIG. 8*a* is a side view of an alternate exemplary refill system in charge mode.
Figure 8B:
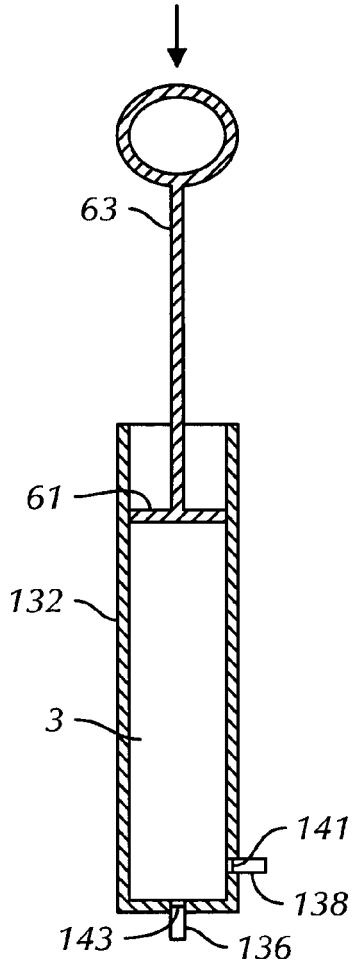
FIG. 8*b* is a side view of an alternate exemplary refill system in discharge mode.

FIGS. 8*a* and 8*b* show an alternate exemplary refill system. Liquid 3 is drawn into the body of refill reservoir 132 in FIG. 8*a* through inlet 138 as piston head 62 is drawn back from refill reservoir 132 by piston rod 63. Inlet 138 functionally includes inlet check valve 141, which permits fluid communication into refill reservoir 132 as piston head 62 creates negative pressure within refill reservoir 132, but prevents flow out of inlet 138 when the pressure within refill reservoir 132 is approximately neutral or greater. Outlet 136 functionally includes outlet check valve 143, which prevents fluid communication out of refill reservoir 132 when the pressure within refill reservoir 132 is approximately neutral or less, yet, as in FIG. 8*b*, permits fluid communication out of refill reservoir 132 as piston head 62 is pushed forward creating positive pressure within refill reservoir 132.

An alternate exemplary embodiment (not shown) is similar to refill reservoir 132, but has a combined inlet 138 and outlet 136, having no check valve. A sufficiently tight seal between the interior of refill reservoir 132 and piston head 62 maintains pressure within refill reservoir 132 so that liquid 3 exclusively moves into and out of refill reservoir 132 through the combined inlet 138/outlet 136, with the respective draw and push of piston head 62.

Figure 9:
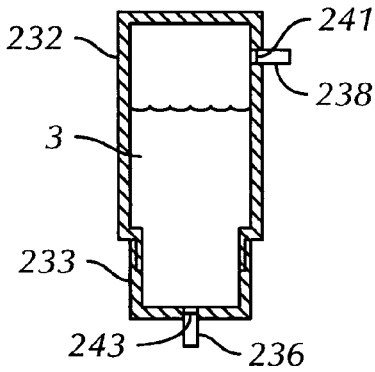
FIG. 9 is a side view of an additional alternate exemplary refill system.

FIG. 9 shows an alternate exemplary refill system. Refill reservoir 232 is configured similarly to a water bottle known to the art, except that outlet 236 functionally includes outlet check valve 243, in removable cap 233 in the exemplary embodiment. Outlet check valve 243 prevents the flow of water 3 out of refill reservoir 232 when the pressure within refill reservoir 232 is approximately neutral or less. Pressure may be created within refill reservoir 232 by squeezing the sides of the refill reservoir 232. Inlet 238 functionally includes inlet check valve 241, which permits fluid communication of gas or liquid 3 into refill reservoir 232 as pressure within refill reservoir 232 falls below neutral, but prevents flow out of inlet 238 when the pressure within refill reservoir 232 is approximately neutral or greater. Though inlet valve 238 is shown distal to outlet valve 236, inlet valve 238 may be positioned in various locations as long as the interior side of inlet valve 238 accesses the interior of refill reservoir 232 distal from where outlet valve 236 accesses the interior. This can be accomplished by integrating a tube extension (not shown) to either inlet valve 238 or outlet valve 236, such that the tube offers fluid flow to a point distal the other valve. The configuration of refill reservoir 232 permits the rapid expulsion of liquid 3 through outlet valve 236 by repeatedly squeezing and releasing the body of refill reservoir 232.

Referring to FIGS. 4, 8*b* and 9, either outlet 136 or outlet 236 may be functionally connected to refill conduit 34 in order force water 3 into reservoir 12 in a similar fashion as described above in the description of the function of refill reservoir 32.

The foregoing disclosure and description of the invention is only illustrative and explanatory thereof. Various changes in the details of the illustrated construction may be made within the scope of the appended claims without departing from the spirit of the invention. No limitations are intended to the details of construction or design, herein shown, or to the methods described herein, other than as described in the claims below. The present invention should only be limited by the following claims and their legal equivalents.

What is claimed is:

1. A hydration system comprising:
a reservoir;
a protective housing;
said protective housing comprising tough material;
said reservoir securable within said protective housing;
said protective housing integrated into an article of personal protective equipment; and said article designed to be worn.

2. The device of claim 1, further comprising:
a conduit to support fluid communication with said reservoir; and
a connector providing releasable fluid communication between said reservoir and said conduit.

3. The device of claim 2, further comprising:
a piece of apparel having an orifice for access to said conduit.

4. The device of claim 2, further comprising:
said connector comprising two components; and
a refill system connectable with one component of said connector to provide fluid communication with said reservoir.

5. The device of claim 4, further comprising:
said refill system having a refill reservoir; and
said refill reservoir capable of holding a refill supply of water and having an outlet valve attachable to said conduit to establish fluid communication between said refill reservoir and said reservoir.

6. The device of claim 5, further comprising:
said refill reservoir having a pressurization system.

7. The device of claim 1, further comprising:
a refill system connectable into fluid communication with said reservoir.

8. The device of claim 1, further comprising:
said reservoir containing a serving of beverage powder.

9. A method for providing personal hydration comprising:
securing a protective housing to an article of personal protective equipment which is designed to be worn, said protective housing comprising tough material;
providing a reservoir to hold a quantity of liquid;
providing a conduit to communicate liquid to a hydration point;
positioning said reservoir within said protective housing; and
establishing fluid communication between said reservoir and said conduit.

10. The method of claim 9, further comprising:
inserting a serving of beverage powder into said reservoir.

11. The method of claim 9, further comprising:
discarding said reservoir after depletion of said quantity of liquid.

12. The method of claim 9, further comprising:
filling at least one additional reservoir with a quantity of liquid in preparation of a future need.

13. The method of claim 9, further comprising:
refilling said reservoir after depletion of said quantity of liquid.

14. The method of claim 13 wherein:
said refilling accomplished with a refill reservoir capable of containing a refill supply of water and having an outlet valve attachable to said conduit to establish fluid communication between said refill reservoir and said reservoir.

* * * * *